US005685731A

United States Patent [19]

Lin

[11] Patent Number: 5,685,731

[45] Date of Patent: Nov. 11, 1997

[54] STRAIN-RELIEF DEVICE FOR USE WITH CABLE-PLUG ASSEMBLIES

[75] Inventor: Mike H. Lin, Cerritos, Calif.

[73] Assignee: International Connectors & Cable Corp., Cerritos, Calif.

[21] Appl. No.: 730,336

[22] Filed: Aug. 26, 1996

Related U.S. Application Data

[63] Continuation of Ser. No. 317,013, Oct. 3, 1994, abandoned.

[51] Int. Cl.[6] ..... H01R 13/625

[52] U.S. Cl. ..... 439/344; 439/447

[58] Field of Search ..... 439/465–467, 439/470, 344, 676, 352

[56] References Cited

U.S. PATENT DOCUMENTS

| | | | |
|---|---|---|---|
| 4,108,527 | 8/1978 | Douty et al. | 439/465 |
| 5,211,706 | 5/1993 | Polgar | 439/465 |
| 5,234,358 | 8/1993 | Polgar | 439/465 |
| 5,334,044 | 8/1994 | Falossi et al. | 439/447 |
| 5,462,457 | 10/1995 | Schroepfer et al. | 439/352 |
| 5,494,457 | 2/1996 | Kunz | 439/447 |
| 5,538,438 | 7/1996 | Orlando | 439/344 |

*Primary Examiner*—Gary F. Paumen

*Attorney, Agent, or Firm*—Pretty, Schroeder & Poplawski

[57] ABSTRACT

The invention is a strain-relief device for use with a cable-plug assembly wherein the wires of the cable are connected to the terminals of a plug. The strain-relief device comprises a first half-housing for receiving the cable-plug assembly, a second half-housing that fits over the first half-housing thereby forming an enclosure that holds the cable-plug assembly immobile, and at least one latch for holding the half-housings together when the latch is engaged. Alignment features incorporated in the half-housings enable a user to bring the half-housings into alignment prior to engaging at least one latch thereby avoiding damage to either half-housing during the assembly of the device. The strain-relief device includes a means for disengaging the latches after the half-housings have been assembled into an enclosure and the latches have been engaged thereby permitting the half-housings to be separated from each other after assembly. The strain-relief device also includes a means for restricting the movement of the plug and cable relative to the enclosure.

19 Claims, 2 Drawing Sheets

5685731

STRAIN-RELIEF DEVICE FOR USE WITH CABLE-PLUG ASSEMBLIES

This application is a continuation of application Ser. No. 08/317,013, filed Oct. 3, 1994, now abandoned.

BACKGROUND OF INVENTION

This invention relates generally to electrical connectors and more specifically to strain-relief devices that hold cables immobile with respect to the connectors to which they are attached thereby preventing strains to the wire connections to the connectors.

With the proliferation of networking and the need to connect a variety of user equipments to wall jacks and to connect user cables to hub equipment, color coding of plugs and/or cables becomes almost essential. The problem with this approach is that cables and attached plugs become dedicated for a single purpose and an inventory of different-colored cable-plug assemblies must be maintained.

Color coding of cable-plug assemblies are also frequently accomplished by using a variety of colors for the associated strain-relief devices. Typically, however, strain-relief devices are one-piece structures that are installed at the time a cable is electrically connected to a connector and cannot be changed. Thus, here also, the cable-plug assemblies become dedicated for a particular use.

A need exists for a strain-relief device that can be installed after the plug and cable are assembled. With such a device, the color coding of a cable-plug assembly can be changed by removing the existing strain-relief device and replacing it with another of a different color.

BRIEF SUMMARY OF INVENTION

The invention is a strain-relief device for use with a cable-plug assembly wherein the wires of the cable are connected to the terminals of a plug. The strain-relief device comprises a first half-housing for receiving the cable-plug assembly, a second half-housing that fits over the first half-housing thereby forming an enclosure that holds the cable-plug assembly immobile, and at least one latch for holding the half-housings together when the latch is engaged.

The latch genus includes a three-member species and a two-member species. In the three-member latch the first member is attached to the first half-housing, the second member is attached to the second half-housing, and a third member serves as the latch engagement means. The latch is engaged when the engagement surface of the third member makes contact with the engagement surfaces of the first and second members. An example of a three-member latch is one where overlapping regions of the first and second half-housings having concentric holes correspond to the first and second members of the latch and a pin corresponds to the third member. Engagement of the latch occurs when the pin passes through the concentric holes in the overlapping regions of the first and second half-housings thereby holding the half-housings together.

In a two-member latch the first member is attached to the first half-housing and the second member is attached to the second half-housing, the engagement surface of at least one of the members being moveable with respect to the engagement surface of the other. The latch becomes engaged when the engagement surface of the first member is moved into a position opposing the engagement surface of the second member and the engagement surfaces of the two members are brought into contact. The engagement surfaces are shaped to resist disengagement. An example of a two-member latch is one where the latch member having the moveable engagement surface is elongated in the assembly direction, the assembly direction being the direction in which the half-housings are brought together in the assembly process to form the enclosure. The elongated member is attached to the first half-housing at one end and has a transverse projection at the other end. The other member of the latch is a portion of the wall of the second half-housing with a hole shaped to receive the transverse projection of the elongated member, the movement of the engagement surface of the elongated member being accomplished by deflecting the member.

The two-member latch has a latch activator which causes the engagement surfaces of a latch to be in disengaged positions ready for engagement prior to the completion of the assembly of a first half-housing to a second half-housing. The latch activator comprises activation surfaces on the two latch members. The activation surfaces come in contact and slide along each other during the assembly of a first housing to a second housing. The activation surfaces are shaped in such a way that the engagement surfaces are brought into disengaged positions prior to the completion of the assembly process as a result of pressing the half-housings together. The activation surface of at least one member is angled with respect to the assembly direction thereby causing the moveable member to move gradually to the disengaged position as the half-housings are brought together.

Alignment features incorporated in the half-housings enable a user to bring the half-housings into alignment prior to engaging at least one latch thereby avoiding damage to either half-housing during the assembly of the device.

The strain-relief device includes a means for disengaging the latches after the half-housings have been assembled into an enclosure and the latches have been engaged thereby permitting the half-housings to be separated from each other after assembly.

The strain-relief device also includes a means for restricting the movement of the plug and cable relative to the enclosure.

DESCRIPTION OF THE PREFERRED EMBODIMENT

Figure 1:
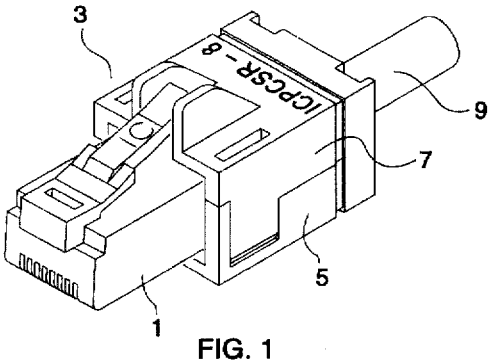
FIG. 1 is an isometric drawing of the preferred embodiment of the strain-relief device enclosing a cable-plug assembly.

The preferred embodiment of the invention is shown assembled around a cable-plug assembly in FIG. 1. For purposes of illustration an RJ45-type modular plug 1 is assumed. The strain-relief device 3 consists of a first half-housing 5 and a second half-housing 7. The cable 9 is shown extending from the rear of the strain-relief device 3.

Figure 2:
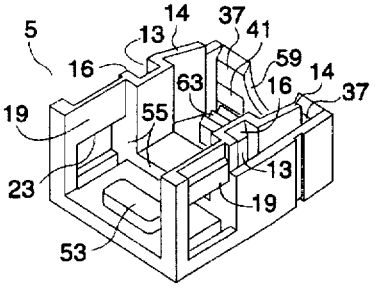
FIG. 2 is an isometric drawing of the interior of the first half-housing for the preferred embodiment of the strain-relief device.
Figure 3:
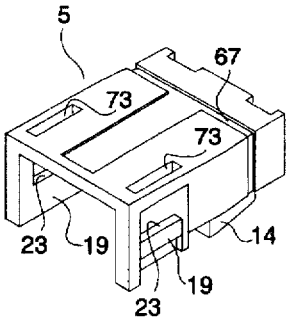
FIG. 3 is an isometric drawing of the exterior of the first half-housing for the preferred embodiment of the strain-relief device.
Figure 4:
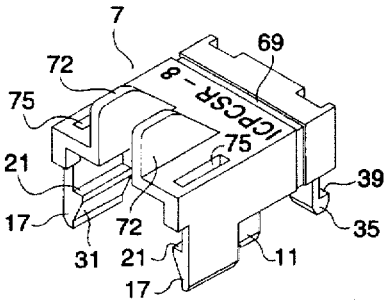
FIG. 4 is an isometric drawing of the exterior of the second half-housing for the preferred embodiment of the strain-relief device.
Figure 5:
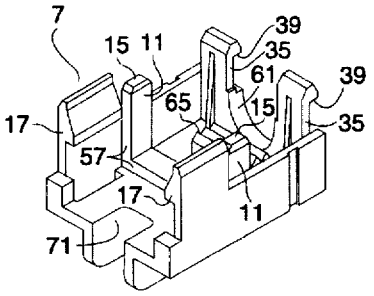
FIG. 5 is an isometric drawing of the interior of the second half-housing for the preferred embodiment of the strain-relief device.

The interior of the first half-housing 5 is shown in FIG. 2 and the exterior in FIG. 3. The exterior and interior of the second half-housing 7 are shown in FIGS. 4 and 5 respectively. The assembly of the two half-housings into an enclosure for the cable-plug assembly can be pictured by bringing the second half-housing 7 as shown in FIG. 4 down on top of the first half-housing 5 as shown in FIG. 2 or by bringing the second half-housing 7 as shown in FIG. 5 up to meet the first half-housing 5 as shown in FIG. 3.

The two half-housings are aligned during the assembly process by the columns 11 entering the channels 13. The distal ends 15 of the columns 11 and the edges 16 of the channels 13 are chamfered to allow easy entry of the columns 11 into the channels 13. Instead of chamfering the distal ends 15 and edges 16, the columns 11 and the channels 13 could have matching tapers so that entry of the columns into the channels is easy and yet close alignment is achieved after the columns have entered the channels. To assure perfect alignment after assembly, the additional projections 14 inside and above the external walls of the first half-housing 5 are provided. These two projections make sliding contact with the internal surfaces of the walls of the second half-housing 7 when the two half-housings come together.

The two half-housings 5 and 7 are held together after assembly by two plug-end latches and two cable-end latches. The plug-end latches consist of moveable members (resilient arms) 17 and stationary members 19, the latter forming parts of the walls of the half-housing 5. The moveable members have engagement surfaces (transverse projections) 21 and the stationary members have engagement surfaces 23 which make contact when the latches are engaged.

Figure 6:
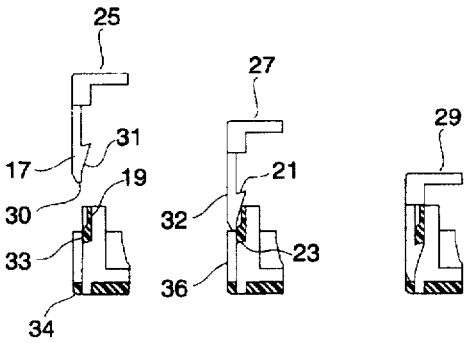
FIG. 6 shows three stages in the process of engaging the preferred embodiment of a plug-end latch, with only the lower half-housing in section.

The plug-end latch engagement process is illustrated in FIG. 6. Stage 25 shows the moveable latch member 17 properly oriented above the stationary latch member 19 and ready to be activated. The activation of the latch is shown in stage 27. As the second half-housing 7 is brought down on top of the first half-housing 5, the activation surface 31 of the moveable member 17 is brought to bear on the activation surface 33 of the stationary member 19. As the second half-housing 7 continues to descend, the moveable member 17 is deflected to the left in FIG. 6 as a result of the ramped activation surface 31. When the moveable member 17 reaches the fully-deflected position, the latch is activated, i.e. ready for engagement. When the two half-housings come together, engagement of the latches occurs. The engagement surface 21 of the moveable member 17 slides past the engagement surface 23 of the stationary member 19, the engagement surface 21 passes through an opening in the wall of the first half-housing 5 to a position opposing the engagement surface 23 and the two engagement surfaces come together when the pressure pushing the two half-housings together is released, as shown in stage 29 of FIG. 6.

The assembly direction is the direction in which the half-housings 5 and 7 are brought together in the assembly process to form the enclosure for the cable-plug assembly. The latch engagement direction is transverse to the assembly direction. The engagement surfaces 21 and 23 are angled with respect to the engagement direction in order to resist disengagement. The angled surfaces are perhaps the easiest approach to providing disengagement resistance above that provided by the ordinary friction between the surfaces. However, a similar effect could be achieved by shaping the surfaces in any one of a variety of ways. For example, the surfaces could have matching corrugations or the surfaces could be pebbled.

The plug-end engagement process begins, as shown in stage 25 of FIG. 6, with the engagement surfaces axially aligned along the assembly direction but at some distance from each other. The process of engagement requires that the latch first be activated by displacing the engagement surface of the moveable member opposite to the engagement direction so that it can pass by the engagement surface of the stationary member. The activation process is accomplished in the present invention by providing activation surfaces that slide by each other when the half-housings are brought together. By properly shaping the activation surfaces and linking one of the activation surfaces to the moveable member of the latch, the moveable member can be caused to assume a position whereby the engagement surfaces are displaced from each other to the degree necessary to pass by each other and permit subsequent engagement.

For ease of assembly, it is best that the activation be accomplished gradually by properly shaping the activation surfaces. The preferred approach is to make the activation surface 33 planar and normal to the engagement direction and to angle the activation surface 31 with respect to the activation surface 33. It is apparent from FIG. 6 that for the first part of the activation process the activation surface 31 slides on the edge of the activation surface 33. After the moveable member 17 is fully deflected, the edge of the activation surface 31 slides along activation surface 33 until engagement of the latch occurs, as shown in stage 29 of FIG. 6. This mode of operation is desirable in that an edge always slides over a surface thereby minimizing friction and reducing the force required to activate and engage the latch. This mode of operation, however, is not essential. Either or both of the activating surfaces can be angled or shaped in some other appropriate way with respect to the assembly direction. With reference to FIG. 6, the movable member 17 includes a distal tip 30 and a surface 32 facing outwardly of the enclosure. The first half-housing has a basewall 34 and a sidewall 36. When the plug end latch is engaged, the distal tip 30 is in opposed relation to the basewall 34 and the outwardly facing surface 32 is flush with the sidewall 36.

The cable-end latches consist of moveable members (resilient arms) 35 and stationary members 37, the latter forming parts of the end wall of the half-housing 5. The moveable members have engagement surfaces (transverse projections) 39 and the stationary members have engagement surfaces 41 which make contact when the latches are engaged.

Figure 7:
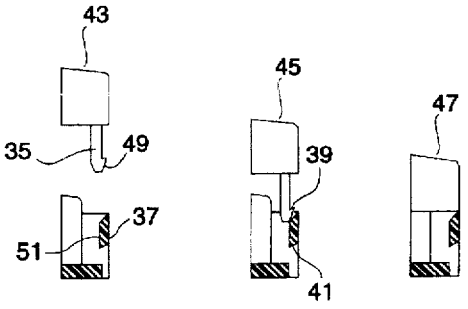
FIG. 7 shows three stages in the process of engaging the preferred embodiment of a cable-end latch, with only the lower half-housing in section.

The cable-end latch engagement process is illustrated in FIG. 7. Stage 43 shows the moveable latch member 35 properly oriented above the stationary latch member 37 and ready to be activated. The activation of the latch is shown in stage 45. As the second half-housing 7 is brought down on top of the first half-housing 5, the activation surface 49 of the moveable member 35 is brought to bear on the activation surface 51 of the stationary member 37. As the second half-housing 7 continues to descend, the moveable member 35 is deflected to the left in FIG. 7 as a result of the ramped activation surface 49. When the moveable member 35 reaches the fully-deflected position, the latch is activated, i.e. ready for engagement. When the two half-housings come together, engagement of the latches occurs. The engagement surface 39 of the moveable member 35 slides past the engagement surface 41 of the stationary member 37, the engagement surface 39 snaps through an opening in the end wall of the first half-housing 5 to a position opposing the engagement surface 41 and the two engagement surfaces come together when the pressure pushing the two half-housings together is released, as shown in stage 47 of FIG. 7.

Like the engagement surfaces 21 and 23, the engagement surfaces 39 and 41 are angled with respect to the engagement direction in order to resist disengagement.

As mentioned previously in connection with the plug-end latches, the angled surfaces are perhaps the easiest approach to providing disengagement resistance above that provided by the ordinary friction between the surfaces. However, a similar effect could be achieved by shaping the surfaces in any one of a variety of ways including matching corrugations and pebbled surfaces.

The cable-end engagement process begins, as shown in stage 43 of FIG. 7, with the engagement surfaces axially aligned along the assembly direction but at some distance from each other. The process of engagement requires that the latch first be activated by displacing the engagement surface of the moveable member opposite to the engagement direction so that it can pass by the engagement surface of the stationary member. The activation process is accomplished by providing activation surfaces that slide by each other when the half-housings are brought together. By properly shaping the activation surfaces and linking one of the activation surfaces to the moveable member of the latch, the moveable member can be caused to assume a position whereby the engagement surfaces are displaced from each other to the degree necessary to pass by each other and permit subsequent engagement.

For ease of assembly, it is best that the activation be accomplished gradually by properly shaping the activation surfaces. The preferred approach is to make the activation surface 51 planar and normal to the engagement direction and to angle the activation surface 49 with respect to the activation surface 51. It is apparent from FIG. 7 that for the first part of the activation process the activation surface 49 slides on the edge of the activation surface 51. After the moveable member 35 is fully deflected, the edge of the activation surface 49 slides along activation surface 51 until engagement of the latch occurs, as shown in stage 47 of FIG. 7. Either or both of the activating surfaces can be angled or shaped in some other appropriate way with respect to the assembly direction.

The first half-housing 5 has a pedestal 53 which fits within a recess in the bottom surface of the modular plug 1 thereby preventing significant axial movements of the modular plug after the half-housings have been assembled into an enclosure. Also serving to restrict the movement of the plug 1 axially is the partial wall 55 in the first half-housing 5 which joins the partial wall 57 in the second half-housing 7 when the two half-housings are brought together to form the enclosure. Lateral movements of the plug 1 are prevented by the sides and bottoms of the two half-housings.

The cable 9 is restricted in lateral movements by the cable support surfaces 59 in the first half-housing 5 and 61 in the second half-housing 7 which surround the cable when the two half-housings are brought together into an enclosure. Movement of the cable 9 is restricted both axially and laterally by the ridged pedestals 63 in the first half-housing 5 and 65 in the second half-housing 7 which clamp the cable when the two half-housings are assembled into an enclosure.

Grooves 67 in the first half-housing 5 and 69 in the second half-housing 7 provide a means for a user to grip the strain-relief device 3 without his fingers slipping when the plug 1 is being inserted into or withdrawn from its jack.

The cutout 71 in the second half-housing 7 provides clearance for the plug lever that enables the removal of the plug from a jack. The plug lever projections 72 prevent the plug from being accidentally disengaged from its jack by an adjacent cable pressing against the plug lever.

The removal of the strain-relief device 5 from the cable-plug assembly is accomplished in the preferred embodiment by inserting and turning a screwdriver in each of the portals 73 which results in the breaking of the stationary members of the latch or in each of the portals 75 which results in the breaking of the moveable members.

Figure 8:
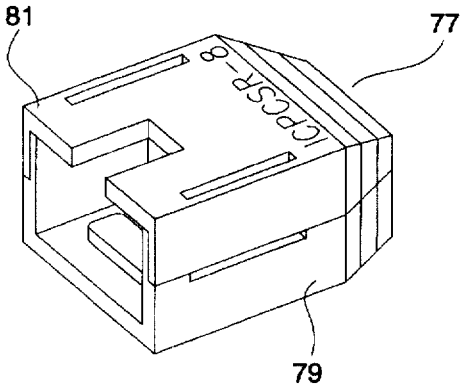
FIG. 8 is an isometric drawing of an alternative embodiment of a strain-relief device.
Figure 9:
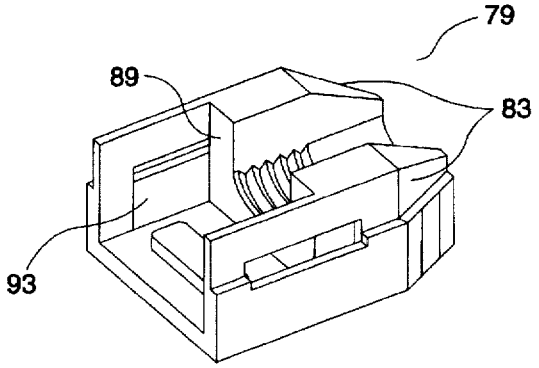
FIG. 9 is an isometric drawing of the interior of the first half-housing for an alternative embodiment of the strain-relief device.
Figure 10:
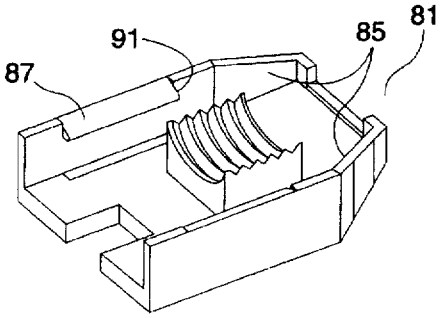
FIG. 10 is an isometric drawing of the interior of the second half-housing for an alternative embodiment of the strain-relief device.

The preferred embodiment of the strain-relief device utilizes columns 11 and channels 13 for the alignment of the half-housings during assembly. Alternative alignment means are mating perimeters or mating features on the perimeters of the half-housings. The possibilities are illustrated in FIGS. 8, 9, and 10. An assembled strain-relief device 77 consisting of alternative embodiments of a first half-housing 79 and a second half-housing 81 is shown in FIG. 8. The first and second half-housings 79 and 81 are shown separately in FIGS. 9 and 10 respectively. Alignment of the two half-housings during assembly is provided in part by the mating angled sides 83 and 85 of the first and second half-housings 79 and 81 respectively. The other alignment features are the latch members 87 located in the second half-housing 81 and the wall 89 in the first half-housing 79. The ends 91 of the latch members must clear the wall 89 in order for the half-housings to be assembled.

The term "latch" is used herein to denote the means by which the half-housings are fastened together to form an enclosure for a cable-plug assembly. The latch utilized in the preferred embodiment of the strain-relief device consists of a stationary member 19 that is part of the first half-housing 5 and a moveable member 17 that is attached to but separate and distinct from the second half-housing 7 (see FIGS. 2, 3, 4, and 5).

The latch members 87 and 93 for the alternative embodiment shown in FIGS. 8, 9, and 10 are each a part of the half-housing to which they are attached. The latches in both embodiments involve a first member having its engagement surface on a projection transverse to the assembly direction and a second member having its engagement surface on one edge of a hole in the wall of its associated half-housing. The hole is shaped to receive the first member's projection. The latches in both cases are engaged when the projection of the first member falls into the hole in the second member's half-housing, and the engagement surfaces of the two members come in contact.

The engagement surface of the second member could also be located on a transverse projection like the first member rather than on the edge of a hole as shown in the figures. In such an embodiment of the second member, the first or second member or both deflect to enable the projections on the two members to pass by each other as the two half-housings come together. When the two projections clear each other, the members snap back and the engagement surfaces come together.

Figure 11:
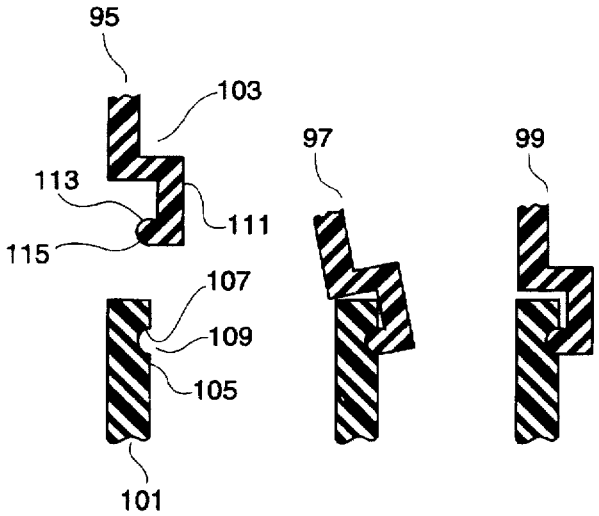
FIG. 11 shows three stages in the process of engaging a hinge-type latch consisting of two half-hinge members.

Three stages in the engagement of a hinge-type latch is shown in FIG. 11. At stage 95 portions of the walls of a first half-housing 101 and a second half-housing 103 that will adjoin each other after assembly are shown positioned one above the other. The latch member 105 is part of the wall of the first half-housing 101 The upper portion of the cylindrical cavity 109 in the latch member 105 is the engagement surface 107.

The latch member 111 is an appurtenance to the wall of the second half-housing 103. The engagement surface 113 is the upper portion of the cylinder 115. The cylindrical mating features 109 and 115 will be called half-hinges in that when they are brought together during assembly of the half-housings, they function together as a hinge that permits a slight rotation of the second half-housing relative to the first.

At stage 97 the half-hinges 109 and 115 are brought together to form a hinge. The length of the half-hinge 109 associated with latch member 105 is less than the length of the half-housing 101. The length of the half-hinge 115 associated with latch member 111 is slightly less than the half-hinge 109. Thus, when the half-hinges are brought together to form a hinge, alignment of the half-housings is automatically accomplished.

The assembly of the half-housings is completed by pivoting the two half-housings on the hinge until the half-housings are brought together. The walls of the half-housings would then be aligned as shown in stage 99 of FIG. 11. Latches of the type illustrated in FIGS. 2, 3, 4, and 5 would be used to hold the half-housings together at the opposite walls.

Figure 12:
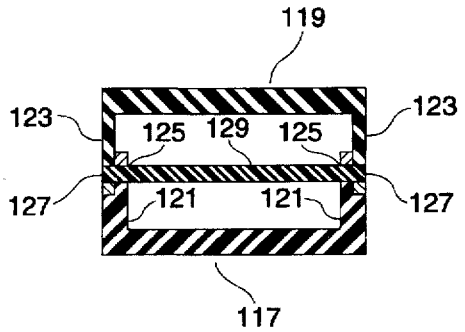
FIG. 12 is a sectional view of a strain-relief device that utilizes a three-member latch.

A sectional view of an embodiment of a latch that involves three latch members instead of two is shown in FIG. 12. The first half-housing 117 is shown assembled to the second half-housing 119 with two latches to form an enclosure. The first latch member 121 (of each latch) is part of the wall of the first half-housing 117. The second latch member 123 is part of the wall of the second half-housing 119. Holes 125 and 127 in the two latch members 121 and 123 respectively are concentric when the half-housings are properly joined together. Latch engagement is accomplished by passing a third latch member 129, a pin, through the holes 125 and 127. The engagement surface of the first member 121 is the top surface of hole 125, the engagement surface of the second member 123 is the bottom surface of hole 127, and the engagement surface of the third member 129 are its top surface where it contacts the engagement surface of the first member 121 and its bottom surface where it contacts the engagement surface of the second member 123.

A common third member is used for the engagement of the two latches on opposite sides of the enclosure. Two separate third members could also be used. In the case of a common third member, one of the holes 127 is slightly smaller than the third member 129 so that after engagement, the third member cannot accidentally fall out. In the case of separate third members, both of the holes 125 are slightly smaller than the third members so that the latches cannot disengage accidentally.

What is claimed is:

1. A strain-relief device for use with a cable-plug assembly, the cable-plug assembly being a cable having wires connected to a plug, the device comprising:

a first half-housing for receiving the cable-plug assembly, the first half-housing having a plug end wall defining an opening for receiving the plug, a cable end wall defining an opening for receiving the cable, and first and second spaced side walls extending between the plug end wall and the cable end wall;

a second half-housing having a plug end wall defining an opening for receiving the plug, a cable end wall defining an opening for receiving the cable, and first and second spaced side walls extending between the plug end wall and the cable end wall, the second half-housing fitting over the first half-housing thereby forming an enclosure that receives the cable-plug assembly between the side walls of the first and second half-housings; and a first cable end latch associated with both cable end walls of the first and second half-housings for holding the half-housings together when the first cable end latch is engaged;

wherein the first cable end latch comprises a moveable first member attached to the first half-housing and a stationary second member attached to the second half-housing, the members having engagement surfaces, the engagement surface of the first member being moveable with respect to the engagement surface of the second member, the latch becoming engaged when the engagement surface of the first member is moved into a position opposing the engagement surface of the second member; and wherein the first member is a resilient arm attached to the first half-housing at one end and having a transverse projection at the other free end and wherein the second member is a portion of the second half-housing shaped to receive the transverse projection of the resilient arm when the first cable end latch is engaged; and wherein the resilient arm is inside the second member during assembly of the latch and deflects toward the interior of the enclosure then away from the interior of the enclosure to engage the latch.

2. The strain-relief device of claim 1, further comprising a first side latch associated with both of the first side walls of the first and second half-housings for holding the half-housings together when the first side latch is engaged.

3. The strain-relief device of claim 2, further comprising a second side latch associated with both of the second side walls of the first and second half-housings for holding the half-housings together when the second side latch is engaged.

4. The strain-relief device of claim 2 further comprising a second cable end latch associated with both cable end walls of the first and second half-housings for holding the half-housings together when the second cable end latch is engaged, wherein the first and second cable end latches are located on opposite sides of the cable openings of the cable end walls of the first and second half-housings.

5. The strain-relief device of claim 3, further comprising a second cable end latch associated with both cable end walls of the first and second half-housings for holding the half-housings together when the second cable end latch is engaged, wherein the first and second cable end latches are located on opposite sides of the cable openings of the cable end walls of the first and second half-housings.

6. The strain-relief device of claim 1, wherein the second member has a hole shaped to receive the transverse projection of the first member when the first cable end latch is engaged.

7. The strain-relief device of claim 1, wherein the engagement surfaces are angled with respect to the direction of disengagement such that, when the latch is engaged, the engagement surface of the second member opposes the movement of the engagement surface of the first member into the interior of the enclosure.

8. The strain-relief device of claim 1 for use with a cable-plug assembly having a plug lever, further comprising:

a cutout in one of the first and second half-housings to provide clearance for the plug lever in assembling the first and second half-housings and to allow the plug lever to be operated after assembly; and two opposed projections extending outwardly from the external surface of said one of the first and second half-housings on opposite sides of the cutout for receiving the plug lever therebetween to prevent inadvertent engagement of the plug lever.

9. The strain-relief device of claim 2, further comprising an alignment feature between the first cable end latch and the first side latch which enables a user to bring the half-housings into alignment prior to engaging at least one of said latches thereby avoiding damage to either half-housing during the assembly of the device;

wherein the alignment feature includes a column provided on one half-housing and a corresponding channel provided on the other half-housing, the engagement of at least one of said latches being possible only after the column has entered the channel.

10. A strain-relief device for use with a cable-plug assembly, the cable-plug assembly being a cable having wires connected to a plug, the device comprising:

a first half-housing for receiving the cable-plug assembly, the first half-housing having a plug end wall defining an opening for receiving the plug, a cable end wall defining an opening for receiving the cable, and first and second spaced side walls extending between the plug end wall and the cable end wall;

a second half-housing having a plug end wall defining an opening for receiving the plug, a cable end wall defining an opening for receiving the cable, and first and second spaced side walls extending between the plug end wall and the cable end wall, the second half-housing fitting over the first half-housing thereby forming an enclosure that receives the cable-plug assembly between the side walls of the first and second half-housings;

a first cable end latch associated with both cable end walls of the first and second half-housings for holding the half-housings together when the first cable end latch is engaged;

a first side latch associated with both of the first side walls of the first and second half-housings for holding the half-housings together when the first side latch is engaged;

wherein each of the first cable end latch and the first side latch comprises a moveable first member attached to one of the first half-housing and the second half-housing, and a stationary second member attached to the other of the first half-housing and the second half-housing, the members having engagement surfaces, the engagement surface of the first member being moveable with respect to the engagement surface of the second member, the latch becoming engaged when the engagement surface of the first member is moved into a position opposing the engagement surface of the second member;

wherein each first member is a resilient arm attached to said one of said half-housings at one end and having a transverse projection at the other free end and wherein each second member is a portion of said other of said half-housings shaped to receive the transverse projection of the resilient arm when said latches are engaged;

wherein the resilient arm of the first cable end latch is inside the second member during assembly of the latch and deflects toward the interior of the enclosure, then away from the interior of the enclosure to engage the first cable end latch; and wherein the resilient arm of the first side latch is outside the second member during assembly of the latch and deflects away from the interior of the enclosure, then toward the interior of the enclosure to engage the first side latch.

11. The strain-relief device of claim 10, further comprising a second side latch associated with both of the second side walls of the first and second half-housings for holding the half-housings together when the second side latch is engaged;

wherein the second side latch comprises a moveable first member attached to one of the first half-housing and the second half-housing, and a stationary second member attached to the other of the first half-housing and the second half-housing, the members having engagement surfaces, the engagement surface of the first member being moveable with respect to the engagement surface of the second member, the latch becoming engaged when the engagement surface of the first member is moved into a position opposing the engagement surface of the second member;

wherein the first member of the second side latch is a resilient arm attached to said one of said half-housings at a one end and having a transverse projection at the other free end and wherein the second member of the second side latch is a portion of said other of said half-housings shaped to receive the transverse projection of the resilient arm when said second side latch is engaged;

wherein the resilient arm of the second side latch is outside the second member of the second side latch during assembly of the second side latch and deflects away from the interior of the enclosure, then toward the interior of the enclosure to engage the second side latch.

12. The strain-relief device of claim 10, further comprising a second cable end latch associated with both cable end walls of the first and second half-housings for holding the half-housings together when the second cable end latch is engaged, wherein the first and second cable end latches are located on opposite sides of the cable openings of the cable end walls of the first and second half-housings;

wherein the second cable end latch comprises a moveable first member attached to one of the first half-housing and the second half-housing, and a stationary second member attached to the other of the first half-housing and the second half-housing, the members having engagement surfaces, the engagement surface of the first member being moveable with respect to the engagement surface of the second member, the latch becoming engaged when the engagement surface of the first member is moved into a position opposing the engagement surface of the second member;

wherein the first member of the second cable end latch is a resilient arm attached to said one of said half-housings at a one end and having a transverse projection at the other free end and wherein the second member of the second cable end latch is a portion of said other of said half-housings shaped to receive the transverse projection of the resilient arm when said second cable end latch is engaged;

wherein the resilient arm of the second cable end latch is inside the second member during assembly of the latch and deflects toward the interior of the enclosure, then away from the interior of the enclosure to engage the second cable end latch.

13. The strain-relief device of claim 11, further comprising a second cable end latch associated with both cable end walls of the first and second half-housings for holding the half-housings together when the second cable end latch is engaged, wherein the first and second cable end latches are located on opposite sides of the cable openings of the cable end walls of the first and second half-housings;

wherein the second cable end latch comprises a moveable first member attached to one of the first half-housing and the second half-housing, and a stationary second member attached to the other of the first half-housing and the second half-housing, the members having engagement surfaces, the engagement surface of the first member being moveable with respect to the engagement surface of the second member, the latch becoming engaged when the engagement surface of the first member is moved into a position opposing the engagement surface of the second member;

wherein the first member of the second cable end latch is a resilient arm attached to said one of said half-housings at a one end and having a transverse projection at the other free end and wherein the second member of the second cable end latch is a portion of said other of said half-housings shaped to receive the transverse projection of the resilient arm when said second cable end latch is engaged;

wherein the resilient arm of the second cable end latch is inside the second member during assembly of the latch and deflects toward the interior of the enclosure, then away from the interior of the enclosure to engage the second cable end latch.

14. The strain relief device of claim 13, further comprising an alignment feature between the first cable end latch and the first side latch which enables a user to bring the half-housings into alignment prior to engaging at least one of said latches thereby avoiding damage to either half-housing during the assembly of the device;

wherein the alignment feature includes a column provided on one half-housing and a corresponding channel provided on the other half-housing, the engagement of at least one of said latches being possible only after the column has entered the channel.

15. The strain-relief device of claim 13, wherein the engagement surfaces of one of the first and second cable end latches are angled with respect to the direction of disengagement such that, when said one cable end latch is engaged, the engagement surface of the second member of said one cable end latch opposes the movement of the engagement surface of the first member of said one cable end latch into the interior of the enclosure.

16. The strain-relief device of claim 13 for use with a cable-plug assembly having a plug lever, further comprising:

a cutout in one of the first and second half-housings to provide clearance for the plug lever in assembling the first and second half-housings and to allow the plug lever to be operated after assembly; and two opposed projections extending outwardly from the external surface of said one of the first and second half-housings on opposite sides of the cutout for receiving the plug lever therebetween to prevent inadvertent engagement of the plug lever.

17. The strain-relief device of claim 10, wherein the second member of the first cable end latch has a hole shaped to receive the transverse projection of the first member of the first cable end latch when the first cable end latch is engaged and wherein the second member of the first side latch has a hole shaped to receive the transverse projection of the first member of the first side latch when the first side latch is engaged.

18. The strain-relief device of claim 11, wherein the second member of the second side latch has a hole shaped to receive the transverse projection of the first member of the second side latch when the second side latch is engaged.

19. The strain-relief device of claim 13, wherein the second member of the second cable end latch has a hole shaped to receive the transverse projection of the first member of the second cable end latch when the second cable end latch is engaged.

* * * * *